United States Patent [19]

Butler et al.

[11] Patent Number: 4,600,502

[45] Date of Patent: Jul. 15, 1986

[54] ADSORBENT PROCESSING TO REDUCE BASESTOCK FOAMING

[75] Inventors: Kevin D. Butler, Sarnia; Harry E. Henderson, Edmonton, both of Canada

[73] Assignee: Exxon Research and Engineering Co., Florham Park, N.J.

[21] Appl. No.: 686,071

[22] Filed: Dec. 24, 1984

[51] Int. Cl.[4] ..... C10G 19/00

[52] U.S. Cl. ..... 208/284; 208/246; 208/247; 208/287; 208/291; 208/293

[58] Field of Search ..... 208/284, 287, 291, 293, 208/246, 247

[56] References Cited

U.S. PATENT DOCUMENTS

| | | | |
|---|---|---|---|
| 1,772,985 | 8/1930 | Culmer | 208/287 |
| 2,034,712 | 3/1936 | Dolbear | 208/287 |
| 2,356,890 | 8/1944 | Schulze | 208/287 |
| 2,381,293 | 8/1945 | Lalande | 208/287 |
| 3,367,862 | 2/1968 | Mason et al. | 208/246 |
| 3,378,484 | 4/1968 | Ferrara et al. | 208/246 |
| 3,542,669 | 11/1970 | DeFeo | 208/91 |
| 3,620,969 | 11/1971 | Turnock et al. | 208/245 |
| 3,830,730 | 8/1974 | Mead et al. | 208/144 |
| 4,152,249 | 5/1979 | Avrillon et al. | 208/212 |

*Primary Examiner*—Curtis R. Davis

*Attorney, Agent, or Firm*—Edward H. Mazer

[57] ABSTRACT

A method for decreasing the foaming tendency of hydrocarbons, particularly lube basestocks, is disclosed. The method comprises passing the hydrocarbon through an adsorption zone having an adsorbent, preferably a basic adsorbent therein. In a preferred embodiment, the method comprises passing the hydrocarbon feedstock through a regenerable multi-bed adsorption zone. The foaming tendency of the hydrocarbon exiting from the bed in service is monitored. The flow to each particular bed in service is discontinued and the bed regenerated when the foaming tendency of the hydrocarbon exiting from each particular bed exceeds a predetermined value.

21 Claims, 1 Drawing Figure

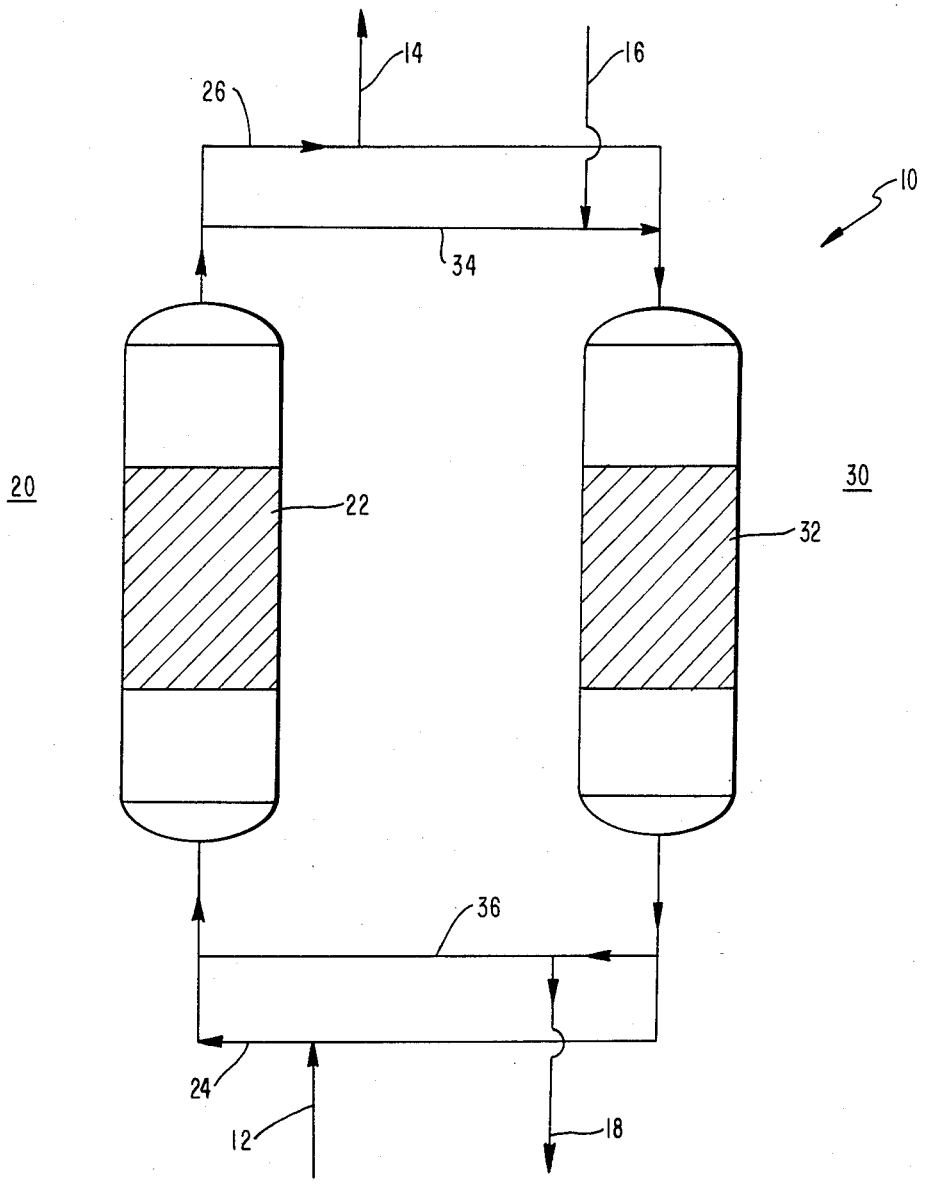
14
16
26
10
34
20
22
30
32
36
24
12
18

ADSORBENT PROCESSING TO REDUCE BASESTOCK FOAMING

BACKGROUND OF THE INVENTION

This invention is related to a method for decreasing the foaming tendency of hydrocarbons. More specifically, the present invention is directed at a method for reducing the tendency for lube basestocks to foam.

Foaming has been a major problem in the manufacture of hydrocarbon products, such as lubricating oils. If the lubricating oils demonstrate excessive foaming with agitation or turbulent flow during use, the lubricant no longer may be delivered effectively to the moving parts as a continuous liquid stream. In addition, foaming may result in overflow losses of the lubricant. Therefore, foaming ultimately may result in inadequate lubrication and mechanical failure.

Efforts to reduce the foaming tendency of lubricating oils have not been entirely satisfactory. When a lubricating oil exhibits an undesirable foaming tendency, conventional treatment generally has comprised the addition of foam suppressors, such as polyalkylsiloxanes and heavy polyesters. However, use of foam suppressors is not always effective, and represents an additional manufacturing expense. Moreover, addition of a foam suppressor to the lubricating oil may lead to blending difficulties because the limited solubility of foam suppressors may make optimal dispersion difficult to achieve. In addition, there are limits to the amount of foam suppressor which can be added without increasing the tendency of the oil to entrain air, which decreases the ability of the oil to lubricate. Thus, some lubricating base oils produced cannot be utilized for their most desirable end uses.

U.S. Pat. No. 4,152,249 discloses that a hydrocarbon, such as a motor oil, can be purified by passing the hydrocarbon through an adsorption resin, such as polycondensates of phenol and/or resorcinol, with formaldehyde and/or 2-formaldehyde, and the porous polycondensates of aliphatic ketones with bis-arylaldehydic compounds optionally comprising one or more phenol and/or pyridyl groups between the two terminal aromatic aldehyde groups.

U.S. Pat. No. 3,830,730 discloses a method of improving the Viscosity Index (VI) of hydrocarbon lubricating charge oils, which comprises substantially completely absorbing the hydrocarbon charge oil on a solid absorbent and then diluting the absorbent with a liquid selective for the higher VI components in the absorbed oil. Among the preferred solid absorbents disclosed are bauxite, calcined bauxite, alumina oxide, silicon oxide, clay, bentonite, diatomaceous earth, Fuller's earth, bone char, charcoal, magnesium silicate, activated kaolin, silica-alumina and zeolites.

U.S. Pat. No. 3,620,969 discloses the use of crystalline zeolitic alumino-silicates for the removal of sulfur compounds from a petroleum feedstock.

U.S. Pat. No. 3,542,669 is directed at the removal of arsenic and arsenic derivatives from petroleum feedstreams by adsorption on activated carbon which preferably had been acid-impregnated.

While all of these patents disclose passing a hydrocarbon feedstock through an adsorption or absorption zone, none of these patents recognizes that the foaming tendency of hydrocarbon feedstocks can be reduced by passing the hydrocarbon feedstock through an adsorption zone.

Accordingly, it would be desirable to provide a process which reduces the foaming tendency of hydrocarbon feedstocks while minimizing or reducing the necessity for the addition of foam suppressors.

It also would be desirable to provide a regenerable process for reducing the foaming tendency of hydrocarbon feedstocks.

It also would be advantageous to provide a process which could be retrofitted onto existing hydrocarbon processing facilities without lengthy shutdown or extensive modifications.

It also would be desirable to provide a process which requires relatively low utility consumption, relatively little maintenance and relatively little operator attention.

The present invention is directed at a method for reducing hydrocarbon foaming by passing the hydrocarbon through an adsorption zone which remove trace components in the hydrocarbon that promote foaming. The adsorption zone preferably is regenerable and preferably comprises a solid exhibiting basic properties, i.e., the solid can be titrated with an acid to measure its basicity.

SUMMARY OF THE INVENTION

The present invention is directed at a method for reducing foaming of a hydrocarbon, said method comprising:

(a) passing the hydrocarbon through an adsorption zone having adsorbent material therein; and (b) regenerating and/or replacing the absorbent material periodically.

The hydrocarbon preferably comprises a lube basestock which has been solvent extracted, and/or hydrotreated and/or dewaxed prior to passing through the adsorption zone. The adsorbent may be regenerated and/or replaced at pre-determined intervals or when the foaming of the hydrocarbon exiting from the adsorption zone exceeds a predetermined value. The hydrocarbon may be passed through the adsorption zone continuously or only during periods when the hydrocarbon foaming exceeds a predetermined value. Where lube basestock is passed through the adsorption zone, less than 1 weight percent of the basestock is retained by the adsorbent material.

The adsorption zone used preferably comprises a regenerable multi-bed adsorption zone having first and second beds which alternately may be utilized in service and regeneration cycles. The adsorbent preferably comprises a solid basic adsorbent. The preferred basic adsorbents are selected from the group consisting of ion exchange resins. Group IIA oxides, mixed oxides, inert supports treated with a solution of a strong base and mixtures thereof. The preferred ion exchange resin comprises anion exchange resin. The preferred Group II oxides comprise magnesium oxide, calcium oxide, strontium oxide and barium oxide, with magnesium oxide and calcium oxide being particularly preferred. The mixed oxides preferably comprise mixed oxides of magnesium oxide or calcium oxide with silica. The inert supports treated with a solution of a strong base preferably comprise materials such as silica or charcoal treated with the hydroxide or carbonate of a Group I or Group II element or an organic amine. The adsorption zone is maintained at a pressure ranging between about 0 psig and about 200 psig, preferably between about 5 psig and about 50 psig. The temperature of the adsorption zone is maintained within the range of about 0° C. to about 250° C., preferably within the range of about 15° C. to about 100° C. The flow rate through the adsorption zone is maintained within the range of about 0.1 to about 20 v/v/hr, preferably within the range of about 0.5 to about 5 v/v/hr.

DESCRIPTION OF THE DRAWING

FIG. 1 is a simplified flow diagram of one embodiment for practicing the subject invention.

DETAILED DESCRIPTION OF THE INVENTION

In the processing of hydrocarbons, particularly in the manufacture of lubricating oils, the tendency of the hydrocarbon to foam is not desired. The present invention relates to the contacting of the hydrocarbon feedstock with a solid adsorption means, preferably a regenerable basic adsorption means, to remove trace compounds present in the hydrocarbon feedstock which promote foaming. As used herein the term "adsorbent" is defined to include solids in the beds which adsorb the foam producing compounds onto their surfaces and/or solids in the beds which absorb the foam producing compounds.

The adsorption means utilized preferably is neutral or basic, with basic adsorption means being particularly preferred for defoaming lubricating oil basestocks. While both neutral and basic adsorbents were effective in reducing the foaming tendency of lubricating oil basestocks, the neutral adsorbents also removed basic nitrogen compounds, which are not believed to contribute to the foaming tendency of the lubricating oil. The removal of the basic nitrogen compounds, therefore, unnecessarily decreased the capacity of the adsorbent as compared to basic adsorbents.

The basic adsorbent preferably is selected from the group consisting of ion exchange resins, oxides of Group IIA of the Periodic Table, mixed oxides, and inert supports treated with a solution of a strong base.

The preferred ion exchange resin comprises anion exchange resin. The preferred Group II oxides comprise magnesium oxide, calcium oxide, strontium oxide and barium oxide, with magnesium oxide and calcium oxide being particularly preferred. The mixed oxides preferably comprise mixed oxides of magnesium oxide or calcium oxide with silica. The inert supports treated with a solution of a strong base preferably comprise materials such as silica or charcoal treated with the hydroxide or carbonate of a Group I or Group II element or an organic amine.

Particularly preferred are the anion ion exchange resins.

The utility of the present invention in reducing the foaming tendency of lubricating oil basestocks, which have been solvent extracted and/or hydrotreated and/or dewaxed to remove aromatic compounds, may be seen from the following examples. As used herein, the term "hydrotreated" refers to the removal of undesired components, such as condensed aromatics and polar components, by passing the oil over a catalyst in the presence of hydrogen at a temperature generally ranging between about 50° C. and about 500° C. and a pressure generally ranging between about 200 and about 4,000 psia.

EXAMPLE 1

In this example, comparative tests were carried out by first mixing the test oil with an equal volume of 1:1 (v/v) heptane/toluene to reduce the viscosity of the test samples and thereby facilitate laboratory studies. The tests were conducted in either of two ways, with the solution maintained at 21° C.:

(a) passing the test solution down a 25 mm ID glass column packed with adsorbent and allowing the test solution to flow under gravity alone; or (b) mixing the test solution with adsorbent in a flask and stirring for 3 hours, followed by filtration.

The solvent subsequently was removed from the test solution by evaporation under vacuum and the oil tested for foaming tendency and stability, utilizing ASTM procedure D892, the disclosure of which is incorporated herein by reference.

In Sequence No. 1, the oil was maintained at 24° C. with air bubbled through the sample by means of a diffuser stone at a constant rate of 94±5 ml/min for 5 minutes. Subsequently, the sample was allowed to settle for 10 minutes. The volume of foam was measured at the beginning and end of this 10 minute period to determine the foaming "tendency" and "stability" of the sample. In Sequence No. 2, this procedure was repeated with a second sample of the test oil at 93.5° C. In Sequence No. 3, the second sample was reused, after foam was allowed to collapse and the sample was cooled to 24° C. The results for the foaming tendencies for Sequence Nos. 1, 2 and 3 for differing samples is presented in Table I. Values for foaming tendency above 100 generally are considered to be unacceptable for formulating many products. Values for foaming preferably should be maintained below about 50. The basic nitrogen concentration of the oil samples was measured by ASTM potentiometric titration procedure D2896, the disclosure of which also is incorporated herein by reference.

TABLE I

FOAMING PROPERTIES OF OILS

| Basestock | Adsorbent | Method | Oil/ Adsorbent Ratio | Foam Tendency Seq. 1 (24° C.) | Foam Tendency Seq. 2 (93.5° C.) | Foam Tendency Seq. 3 (24° C.) | Basic Nitrogen Concentration of Oil Exiting Adsorption Zone (wppm) |
|---|---|---|---|---|---|---|---|
| 150 Neutral | None | — | — | 355 | 80 | 435 | 28 |
| | Amberlyst A-26 strong base resin | continuous | 6.0 wt/wt | 20 | 75 | 40 | — |
| | Amberlyst A-26 strong base resin | batch | 4.5 | 20 | 23 | 35 | 27 |
| | Dow MWA-1 weak base | batch | 3.6 | 10 | 10 | 10 | 27 |
| | Calcium Oxide (non-activated) | batch | 3.6 | 40 | 20 | 80 | 26 |
| | Calcium Oxide (activated at 650° C., 4 hr) | batch | 3.6 | 80 | 20 | 80 | 27 |
| | Merck 'basic' alumina 90 | batch | 3.6 | nil | 10 | nil | 9 |
| | Amberlyst 15 strong acid resin | continuous | 6.0 | 435 | 30 | 410 | 0 |

TABLE I-continued

FOAMING PROPERTIES OF OILS

| Basestock | Adsorbent | Method | Oil/ Adsorbent Ratio | Foam Tendency Seq. 1 (24° C.) | Seq. 2 (93.5° C.) | Seq. 3 (24° C.) | Basic Nitrogen Concentration of Oil Exiting Adsorption Zone (wppm) |
|---|---|---|---|---|---|---|---|
| 600 Neutral | None | — | — | 460 | 100 | 600 | 42 |
| | Amberlyst A-26 strong base resin | continuous | 6.0 wt/wt | nil | 10 | nil | — |
| | Dow MWA-1 weak base resin | batch | 3.6 | 5 | 10 | nil | 42 |
| | Calcium Oxide (non-activated) | batch | 3.6 | 5 | 25 | 10 | 42 |
| | Florisil | batch | 4.3 | nil | 20 | nil | 0 |
| | Amberlyst 15 strong acid resin | continuous | 6.0 | 210 | 30 | 210 | 0 |
| 100 Neutral | None | — | — | 385 | 25 | 370 | 2 |
| | Dow MWA-1 weak base resin | batch | 10.3 wt/wt | 40 | 25 | 80 | 1 |
| 150 Neutral | None | — | — | 535 | 20 | 470 | 11 |
| | Dow MWA-1 weak base resin | batch | 10.3 wt/wt | 30 | 15 | 20 | 9 |
| 60 Neutral | None | — | — | 160 | 30 | 120 | 128 |
| Distillate | Dow MWA-1 weak base resin | batch | 10.8 wt/wt | 70 | 30 | 90 | 120 |
| Bright | None | — | — | 30 | 220 | 120 | 68 |
| Stock | Dow MWA-1 weak base resin | batch | 10.8 vol/wt | nil | nil | nil | 62 |

A review of the test results presented in Table I shows that only the strongly acidic ion exchange resin, Amberlyst 15, was not effective in reducing the tendency to foam. The neutral adsorbents, Florisil, and Merck 90 alumina—which is a base supported on an alumina support retaining the adsorption characteristics of the alumina support—decreased foaming, removed basic nitrogen and removed color from the oil. Since removal of the basic nitrogen compounds and removal of color normally are not required, these adsorbents may become exhausted unnecessarily rapidly. By comparison, the strongly basic and weakly basic ion exchange resins were effective in reducing foaming tendency without removing basic nitrogen compounds. Calcium oxide also appeared to be effective in reducing foaming to acceptable levels, although the D892 foaming tendency values were not as low as for the test utilizing the basic ion exchange resin.

The recoveries for all test samples were at least 99.4% and normally 99.9%, demonstrating that the adsorbent beds should be operable for extended periods before replacement and/or regeneration.

EXAMPLE 2

In this Example, tests were conducted to verify that the results presented in Example 1 had not been affected significantly by the addition of solvent to the lube oil, since in commercial operation, solvent preferably would not be added to the lube oil prior to passing the feed through an adsorption zone. The test data set forth in Table II confirms that use of an adsorption zone reduces the tendency of the oil sample to foam even when solvent is not added to the sample. A series of comparative batch tests were conducted, both with and without solvent addition, using a weakly basic ion exchange resin, a constant time of 6 hours, at an oil sample:adsorbent wt/wt ratio of 3.6:1. The solvent comprised a 50/50 (v/v) mixture of heptane/toluene. Sequence No. 1 again was conducted at a temperature of 24° C. Sequence No. 2 was conducted at a temperature of 93.5° C. on a second sample. Sequence No. 3 was conducted on the second sample after the foam had collapsed and the sample had been cooled to 24° C.

TABLE II

| Basestock | Adsorbent | Wt/Oil (g) | Vol Solvent (ml) | Process Temp °C. | Seq. 1 (24° C.) | Seq. 2 (93.5° C.) | Seq. 3 (24° C.) | Basic Nitrogen Conc. Of Oil Exiting Adsorption Zone (wppm) |
|---|---|---|---|---|---|---|---|---|
| 150 Neutral | None | 250 | 0 | — | 350 | 35 | 330 | |
| | Weak base resin | 250 | 250 | 21° C. | 30 | 20 | 130 | 26 |
| | Weak base resin | 250 | 0 | 21° C. | 0 | 30 | 10 | 27 |
| | Weak base resin | 250 | 0 | 40 | 0 | 20 | 15 | 28 |

EXAMPLE 3

This test was designed to determine the ability of an adsorbent to decrease the foaming tendency of the oil sample after substantial quantities of the oil had been passed over the adsorbent without adsorbent regeneration. In this test, 1,100 ml of a 150 Neutral basestock maintained at 21° C. was passed over a weak base ion exchange resin and collected as ten fractions of approximately equal volume. As shown by the data in Table III, for tests performed on the untreated oil and on alternate samples of the treated oil, the adsorbent significantly reduced the tendency for the oil to foam in all treated samples, thus demonstrating that the capacity of this adsorbent to decrease foaming had not been exhausted even with this 20:1 wt:wt sample:adsorbent ratio. Subsequent extraction of the adsorbent with a 5/95 (v/v) mixture of methanol/toluene readily removed the adsorbed materials.

TABLE III

| Base-stock | Adsorbent | Oil/ Adsorbent Ratio (wt/wt) | Foam Tendency (24° C.) | Basic Nitrogen Concentration of Oil Exiting Adsorption Zone |
|---|---|---|---|---|
| 150 Neutral | Dow MWA-1 weak base resin | untreated | 335 | 28 |
| | | 4 | nil | 27 |
| | | 8 | nil | not tested |
| | | 12 | nil | not tested |
| | | 16 | 10 | not tested |
| | | 20 | 5 | 27 |

The present invention may be practiced using either a batch or a continuous process, with the adsorbent being discarded or regenerated after use. It is preferred to utilize the present invention in a continuous process in which the adsorbent is regenerated after use. Referring to the FIGURE, one method for practicing the invention is shown. In this FIGURE all valves, piping, instrumentation, etc. not essential for an understanding of the invention have been eliminated to simplify the FIGURE. In this FIGURE, adsorption system 10 preferably comprises a plurality of adsorption zones, such as adsorption zones 20, 30, arranged in parallel to permit one zone always to be in the service mode, while the other zone is in the standby or regeneration mode. In this embodiment, zone 20 will be assumed to be in the service mode and zone 30 in the regeneration mode. Hydrocarbon feed is shown passing from line 12 through line 24, into adsorption zone 20 having adsorption bed 22. After passing through bed 22, the treated feed exits through lines 26 and 14. While zone 20 is in the service cycle contacting feed, zone 30 may be in the regeneration cycle. For example, solvent and/or steam may be added through lines 16 and 34 into zone 30, to remove adsorbate from bed 32, with the solvent and/or steam exiting zone 30 through lines 36 and 18. The valving arrangements required are well-known in the art and do not form a part of the invention. The flow of the hydrocarbon feed, such as a lubricating oil feedstock, may be either upflow or downflow, with upflow being preferred to avoid channelization of the hydrocarbon feed through the column, particularly at low flow rates. The size of adsorption beds 22, 32 in zones 20, 30, respectively, will be a function of several factors, including the feed flow rate, concentration of adsorbate, and the desired period between regenerations.

While the adsorbent material in bed 22 could be replaced with fresh material when it becomes exhausted, normally it will be less expensive to regenerate the adsorbent material by means well-known in the art. The method by which zones 22, 32 are regenerated will be dependent upon the particular adsorbent material utilized. Where ion exchange resin is utilized, a preferred method may be steam stripping or solvent washing. Where thermally stable adsorbent materials, such as calcium oxide, are used it may be preferred to burn the adsorbate off the catalyst.

While the subject process has been described with reference to a continuous adsorption system, it is obvious that a batch system could be utilized with the adsorption system shut down for regeneration and/or catalyst replacement.

What is claimed is:

1. A process for reducing foaming of a lube basestock which has been solvent extracted, and/or hydrotreated and/or dewaxed to remove aromatics, said method comprising:

(a) passing the lube basestock through an adsorption zone having adsorbent material therein; and (b) regenerating and/or replacing adsorbent material when the foaming of the lube basestock exceeds a predetermined value.

2. The process of claim 1 wherein the adsorption zone comprises a first adsorption zone and a second adsorption zone, the flow of lube basestock being switched from the first zone to the second zone when the foaming of the lube basestock exiting the first zone exceeds a predetermined value.

3. The process of claim 1 wherein less than 1 weight percent of the lube basestock passed through the adsorption zone is retained by the adsorbent material.

4. The process of claim 3 wherein the adsorbent material comprises a solid basic adsorbent.

5. The process of claim 4 wherein the solid basic adsorbent is selected from the group consisting of ion exchange resin, Group IIA oxides, mixed oxides, inert supports treated with a solution of a strong-base, and mixtures thereof.

6. A process for reducing foaming of a hydrocarbon, said method comprising:

(a) passing the hydrocarbon through an adsorption zone having adsorbent material therein;

(b) monitoring the foaming of the hydrocarbon exiting from the adsorption zone; and (c) regenerating and/or replacing the adsorbent material when the monitored hydrocarbon foaming exceeds a predetermined value.

7. A process for decreasing the foaming tendency of a hydrocarbon, said method comprising:

(a) measuring the degree of hydrocarbon foaming; and (b) passing the hydrocarbon through an adsorption zone having adsorbent material therein when the hydrocarbon foaming exceeds a predetermined limit.

8. A process for reducing foaming of a dewaxed and/or solvent extract lube basestock, said process comprising:

(a) passing lube basestock through an adsorption zone having solid basic adsorbent material therein; and (b) regenerating and/or replacing adsorbent material when the foaming of the lube basestock exceeds a predetermined value.

9. The process of claim 8 wherein the solid basic adsorbent is selected from the group consisting of ion exchange resin, Group IIA oxides, mixed oxides, inert supports treated with a solution of strong base, and mixtures thereof.

10. The process of claim 9 wherein the ion exchange resin comprises an anion ion exchange resin.

11. The process of claim 9 wherein the Group IIA oxide is selected from the group consisting of magnesium oxide, calcium oxide, strontium oxide, barium oxide and mixtures thereof.

12. The process of claim 9 wherein the mixed oxides are selected from the group consisting of magnesium oxide, calcium oxide and mixtures thereof with silica.

13. The process of claim 9 wherein the inert support treated with a solution of a strong base comprises silica or charcoal treated with the hydroxide or carbonate of a Group I or Group II element or an organic amine.

14. The process of claim 9 wherein the adsorption zone is maintained at a temperature ranging between about 0° C. and about 250° C. and a pressure ranging between about 0 psig and about 200 psig.

15. The process of claim 14 wherein the lube basestock flow rate through the adsorption zone is maintained within the range of about 0.1 to about 20 v/v/hr.

16. The process of claim 15 wherein the temperature ranges between about 15° C. and about 100° C.

17. The process of claim 16 wherein the pressure is maintained between about 5 psig and about 50 psig.

18. The process of claim 17 wherein the flow rate is maintained within the range of about 0.5 to about 5 v/v/hr.

19. The process of claim 18 wherein the adsorption zone comprises a multi-bed adsorption zone.

20. A process for reducing foaming of a hydrocarbon comprising:

(a) passing the hydrocarbon through an adsorption zone containing a solid basic adsorbent selected from the group consisting of ion exchange resin, mixed oxides, inert supports treated with a solution of strong base and mixtures thereof; and (b) regenerating and/or replacing the adsorbent when the foaming exceeds a predetermined value.

21. The process of claim 20 wherein the hydrocarbon is a lube basestock.

* * * * *